US006211498B1

(12) United States Patent
Patridge et al.

(10) Patent No.: US 6,211,498 B1
(45) Date of Patent: Apr. 3, 2001

(54) INDUCTION HEATING APPARATUS AND TRANSFORMER

(75) Inventors: Donald F. Patridge, Los Gatos; Henry W. Koertzen, Aptos, both of CA (US)

(73) Assignee: Powell Power Electronics, Inc., Pleasanton, CA (US)

( * ) Notice: Subject to any disclaimer, the term of this patent is extended or adjusted under 35 U.S.C. 154(b) by 0 days.

(21) Appl. No.: 09/260,369

(22) Filed: Mar. 1, 1999

(51) Int. Cl.[7] ..... H05B 6/04
(52) U.S. Cl. ..... 219/660; 333/32
(58) Field of Search ..... 219/660, 666, 219/638, 663; 333/17.3, 12, 127, 33, 32, 340, 132; 330/8; 363/32, 16; 117/52

(56) References Cited

U.S. PATENT DOCUMENTS 2,551,756 * 5/1951 Mittelmann ..... 219/666
2,858,406 10/1958 Boyd et al. ..... 219/10.75

(List continued on next page.)

OTHER PUBLICATIONS

Carsten, B., "A Hybrid Series–Parallel Resonant Converter for High Frequencies and Power Levels", High Frequency Power Conversion Conference, Apr. 1987, Proceedings, pp. 41–47.

Fischer et al., "An Inverter System for Inductive Tube Welding Utilizing Resonance Transformation" (1994) IEEE, pp. 833–840.

Fleischman, H., "Inductive Cooking—From the Idea to the Product" (with English language abstract), Elektrotechnik, vol. 35, No. 6 65—Jun. 1984.

Fuji Electric, New 3rd–Generation Fuji IGBT Modules—N series, Application Manual, 1995, p. 5–7.

Lenny, C., "Coax Transformer", PCIM, Jun. 1998, pp. 40–45.

*Primary Examiner*—Teresa Walberg
*Assistant Examiner*—Quang Van
(74) *Attorney, Agent, or Firm*—Fliesler Dubb Meyer & Lovejoy LLP

(57) ABSTRACT

Induction heating apparatus has a series inductor between an AC source and a parallel tank circuit. The source has an output transformer which has a leakage inductance, viewed from the secondary, no larger than $$L_{l\max} = \frac{V_{L\min} V_{p\min} PF_{\min}}{2\pi N f_{\max} P_{\max}},$$

where $V_{Lmin}$ is a desired minimum permitted voltage across the tank circuit, $V_{pmin}$ is a desired minimum turns input voltage to the output transformer, N is the primary:secondary turns ratio of the output transformer, $PF_{min}$ is a desired minimum permitted power factor, $f_{max}$ is a desired maximum frequency of operation, and $P_{max}$ is a desired maximum power output into the induction heating coil. The output transformer has inner and outer hollow coaxial windings the inner winding being electrically continuous through T turns, and the outer winding having S electrically broken but parallel-connected longitudinal segments. If necessary to reduce inter-winding capacitance, the transformer can further include a core. The system can be easily tuned by a procedure which involves first selecting a preliminary series inductance and a preliminary resonance capacitance. The operator operates the system at low power, increasing resonance capacitance if the system is operating at a frequency that is higher than desired, and decreasing resonance capacitance if the system is operating at a frequency that is lower than desired. Once the operating frequency is acceptable, the operator then operates the system at full power, increasing the series inductance if the system is current limiting, and decreasing the series inductance if the system is resonance limiting. When the series inductance is acceptable, the system is ready for use.

28 Claims, 7 Drawing Sheets

U.S. PATENT DOCUMENTS

| | | | | |
|---|---|---|---|---|
| 3,309,599 | | 3/1967 | Broomhall | 321/24 |
| 3,614,694 | | 10/1971 | Koontz | 336/174 |
| 3,985,947 | * | 10/1976 | Keller | 117/52 |
| 4,032,850 | | 6/1977 | Hill | 325/446 |
| 4,092,607 | | 5/1978 | Robins | 330/8 |
| 4,112,394 | | 9/1978 | Kershaw | 333/6 |
| 4,463,414 | | 7/1984 | Landis | 363/86 |
| 4,500,832 | | 2/1985 | Mickiewicz | 323/340 |
| 4,554,518 | | 11/1985 | Baer | 333/33 |
| 4,634,958 | | 1/1987 | Cornwell | 323/255 |
| 4,774,481 | | 9/1988 | Edwards et al. | 333/127 |
| 4,777,466 | | 10/1988 | Bordalen | 336/180 |
| 4,900,887 | * | 2/1990 | Keller | 219/638 |
| 4,980,654 | | 12/1990 | Moulton | 333/12 |
| 5,159,540 | * | 10/1992 | Lee | 363/22 |
| 5,402,329 | | 3/1995 | Wittenbreder, Jr. | 363/16 |
| 5,504,309 | | 4/1996 | Geissler | 219/663 |
| 5,572,170 | * | 11/1996 | Collins et al. | 333/32 |
| 5,574,410 | * | 11/1996 | Collins et al. | 333/17.3 |
| 5,666,047 | | 9/1997 | Johnson et al. | 323/359 |
| 5,705,971 | | 1/1998 | Skibinski | 336/82 |
| 5,745,357 | | 4/1998 | Matsumoto | 363/84 |

* cited by examiner

INDUCTION HEATING APPARATUS AND TRANSFORMER

BACKGROUND OF THE INVENTION

1. Field of the Invention

The invention relates to induction heating systems, and more particularly, to apparatus and methods for delivering optimum power to a workpiece over a wide range of operating conditions.

2. Description of Related Art

Induction heating systems heat an electrically conductive workpiece by magnetically inducing eddy currents therein. Electrical resistance in the eddy current paths in the workpiece cause $I^2R$ losses, which in turn heat the workpiece.

One type of induction heating system includes a power supply inverter, which has an AC voltage output having a desired frequency of operation. The output of the inverter is usually connected through a step-down transformer to a pair of power supply output terminals, across which is connected the series combination of a series inductor and a resonant tank circuit. The tank circuit includes a work coil in parallel combination with a resonance capacitor. The work coil, in operation, is. placed in proximity with the workpiece, and creates the oscillating magnetic field which induces the eddy currents in the workpiece.

Depending on the application, a wide variety of different operating conditions may be desired. For example, different applications may require different frequencies of operation. Frequencies commonly used for induction heating range anywhere from approximately 10 kHz to approximately 400 kHz. Different applications can also require different voltages across the work coil. Additionally, depending on the configuration and composition of the workpiece, the power factor of the energy delivered to the work coil could also vary widely.

Most induction heating systems are designed for a particular application. For example, a system designed to heat automobile bodies for the purpose of drying paint that has been applied to the surface, need only be designed to operate at one particular frequency, voltage and power factor. It is desirable, however, to provide a general-purpose induction heating system which can be used in a wide variety of applications, under a wide variety of different circumstances. For example, it would be desirable to permit a user to select the operational frequency over the full range of typical frequencies, 10 kHz–400 kHz. Adjustability within this large range of frequencies, spanning a range of 40:1, is extremely difficult to support. Even a range of 50 kHz–400 kHz (8:1) is very difficult to support. It is desirable to provide a system which supports a large range of operating conditions.

In addition, systems which do support a range of operating conditions typically require an operator to tune the system prior to operation. Tuning procedures for such systems are typically complicated and require a technical understanding of the principles under which the induction heating system operates. Accordingly, skilled or trained operators are usually required to operate induction heating systems intended to support a variety of operating conditions. It is therefore desirable to provide an induction heating system and method which simplifies the tuning process.

SUMMARY OF THE INVENTION

According to the invention, roughly described, induction heating apparatus has a series inductor $L_s$ between an AC source and a parallel tank circuit. The AC source has a variable frequency inverter, and an output transformer which has a leakage inductance, viewed from the secondary, no larger than $$L_{t\max} = \frac{V_{L\min} V_{p\min} PF_{\min}}{2\pi N f_{\max} P_{\max}}, \tag{1}$$

where $V_{Lmin}$ is a desired minimum permitted rms voltage across the tank circuit, $V_{pmin}$ is a desired minimum rms input voltage to the output transformer, N is the primary:secondary turns ratio of the output transformer, $PF_{min}$ is a desired minimum permitted power factor, measured at the input of the transformer (ignoring the effect of the magnetizing inductance), $f_{max}$ is a desired maximum frequency of operation, and $P_{max}$ is a desired maximum power output into the induction heating coil.

The output transformer achieves such a low leakage inductance because of its construction as inner and outer hollow windings disposed substantially coaxially with each other, the inner winding being electrically continuous through T turns, and the outer winding having S electrically broken longitudinal segments through the T turns, S>1 . All of the outer winding segments are connected in parallel with each other. The inner and outer windings can be made of braided stranded wire, instead of solid wire or solid tubes, and the insulation between them is made very thin. If necessary to also reduce inter-winding capacitance, the transformer can further include a core.

In another aspect of the invention, a very simple tuning procedure is set forth for tuning an induction heating system which has a series inductor between an AC source and a parallel tank circuit. The tuning procedure involves first selecting a preliminary series inductance and a preliminary resonance capacitance. The operator then operates the system at low power, increasing the resonance capacitance if the system is operating at a frequency that is higher than desired, and decreasing resonance capacitance if the system is operating at a frequency that is lower than desired. Once the frequency is acceptable, the operator then operates the system at fill power, increasing the series inductance if the system is current limiting, and decreasing the series inductance if the system is resonance limiting. When the series inductance is acceptable, the system is ready for use.

BRIEF DESCRIPTION OF THE DRAWINGS

The invention will be described with respect to particular embodiments thereof, and reference will be made to the drawings, in which.

DETAILED DESCRIPTION

Figure 1:
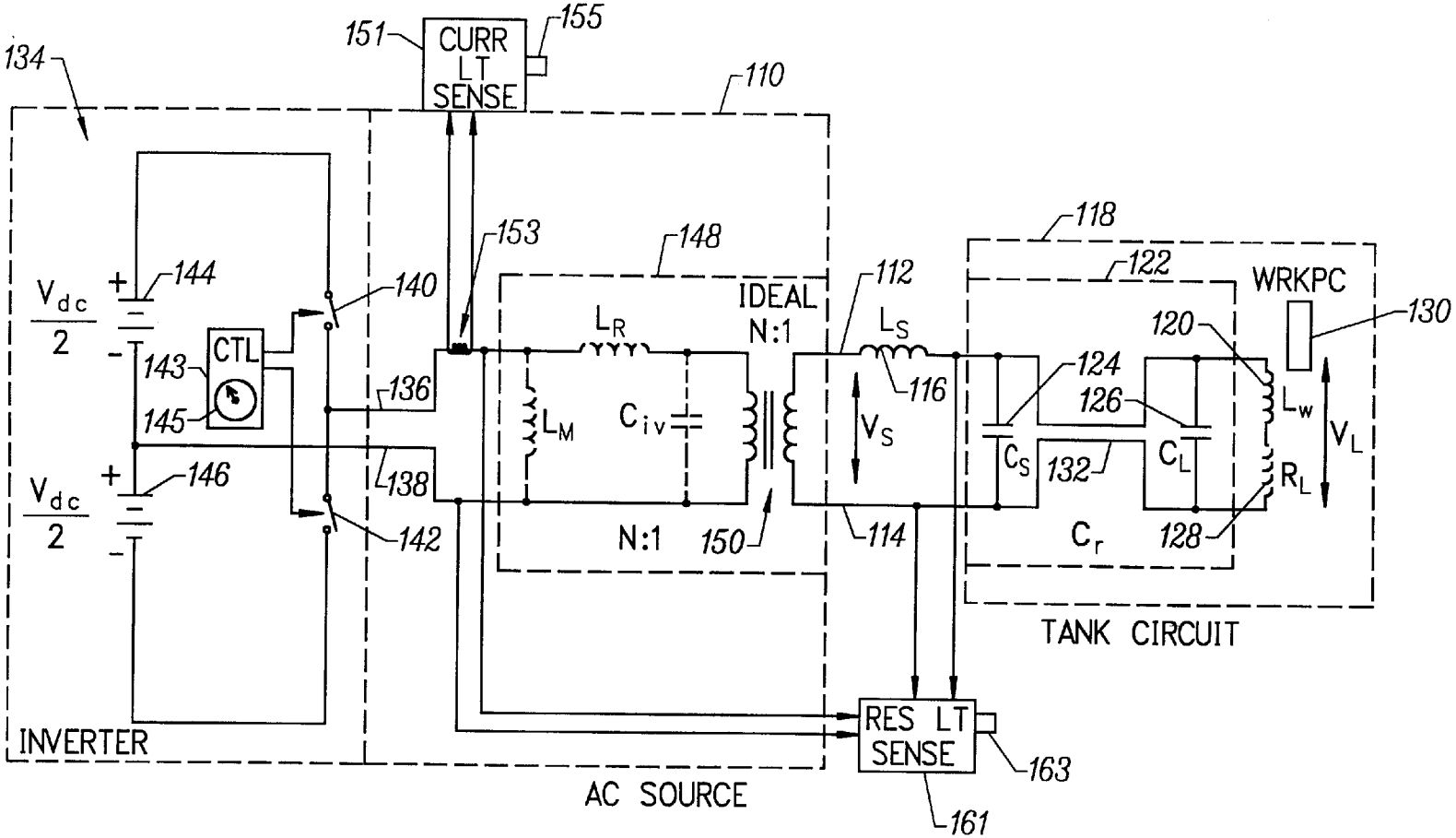
FIG. 1 is a partially simplified schematic diagram of an induction heating system according to the invention.

FIG. 1 is a partially simplified schematic diagram of an induction heating system according to the invention. It includes an AC power source 110 having voltage outputs 112 and 114. Connected across the outputs 112 and 114 are, in series combination, a series inductor 116 and a tank circuit 118. The tank circuit includes a work coil 120 connected in parallel with a resonance capacitance 122, which is implemented as two parallel-connected capacitors 124 and 126, for reasons described hereinafter. Also shown in FIG. 1 is a load resistance 128, shown in broken lines because it represents the resistance with which a workpiece 130 and the work coil appear to the induction heating system. The voltage output of the AC source 110 is $V_s$, measured in volts RMS. The inductor 116 has a value $L_s$, the work coil has an inductance $L_W$, and the voltage across the work coil 120 and tank circuit 118 is $V_L$. The resonance capacitance has a value $C_r$, which is divided into two capacitors connected across either end of the load cabling 132. The value of the capacitor nearest the AC source 110 is $C_s$, and the value of the capacitor nearest the work coil 120 is $C_L$.

AC source 110 includes a half-bridge inverter 134 having outputs 136 and 138. The inverter includes a series pair of switches 140 and 142 connected across a series pair of DC power sources 144 and 146, each having a voltage $V_{dc}/2$. The inverter outputs 136 and 138 are connected to the junction between the two DC sources 144 and 146, and to the junction between the two switches 140 and 142, respectively. The switches 140 and 142 are controlled by a control unit 143, which includes a meter 145 indicating the current frequency of operation. Note that other embodiments could use other kinds of conventional inverters, such as a full-bridge inverter.

Although not required in all induction heating systems, the AC source 110 of FIG. 1 includes an output transformer 148. The transformer 148 has primary terminals connected across the outputs 136 and 138 of the inverter 134, and further has secondary terminals which form the voltage output terminals 112 and 114 of the AC source 110. Such an output transformer is typically included in induction heating systems for electrical isolation, step-down impedance matching, and safety reasons. There are various equivalent circuits that are used to describe the electrical performance of transformers, one of which is shown in FIG. 1. It includes an ideal transformer 150 having a primary:secondary turns ratio of N:1. Connected across the primary of the ideal transformer 150 is the inter-winding capacitance $C_{iw}$. The leakage inductance $L_l$ is shown in series with the primary, between the inter-winding capacitance and one of the primary terminals 136, and the magnetizing inductance of the transformer 148 $L_M$ is shown across the primary input terminals 136 and 138. The inter-winding capacitance, leakage inductance and magnetizing inductance are shown in broken lines since they represent inherent, rather than separate, components. It will be appreciated that one or more of these components could be shown instead on the secondary side of the ideal transformer 150, with an appropriate transposition factor related to the turns ratio of the ideal transformer 150. For example, the leakage inductance as viewed from the secondary of transformer 148 is $L_l/N^2$. Also, it will be appreciated that the resistance representing the power loss in the conductors and cores of the transformer 148 are omitted for clarity of illustration.

The system of FIG. 1 also includes a current limit sense circuit 151, which is connected to a current transformer 153 disposed adjacent to one of the output leads of the inverter 134. The current limit sense circuit 151 senses the inverter output current and, when its peak reaches a preset threshold value limits the current and activates a current limit indicator 155. The threshold is based on the current rating of the semiconductor switches 140 and 142, among other things.

The system of FIG. 1 also includes a resonance limit sense circuit 161, having a first input port connected to sense the instantaneous inverter output voltage, and a second input port connected to sense the instantaneous voltage across the resonance capacitor 122. Where the resonance capacitor 122 is split into capacitors 124 and 126, the second input port is connected to sense the instantaneous voltage across the capacitor nearest the AC source 110, i.e., capacitor 124 in FIG. 1. The resonance limit sense circuit 161 compares the phases of the signals on its two input ports, and when the phase lag of the capacitor voltage relative to the inverter output voltage decreases to 90°, the circuit 161 limits the frequency or phase lag and activates a resonance limit indicator 163.

The series inductance between the AC source 110 and the work coil 120 determines the power that will be delivered by the system at a specific frequency and power factor. Thus, in order to achieve maximum power output over a very large range of operational frequencies and power factors, this inductance needs to be adjustable over a wide range. In one embodiment, inductor 116 has multiple taps, permitting an operator to select an appropriate inductor value $L_s$. In another embodiment, a pair of connector terminals is provided and the operator removes and replaces the inductor 116 with one having an appropriate value.

The inductance between the AC source 110 and the load coil 120 is not, however, due only to the inductor 116. Inductance also exists in the load cabling 132 and in the leakage inductance of the transformer 148. Transposed to the secondary, the leakage inductance of the transformer 148 has a value of $L_l/N^2$ and appears as part of an output inductance of the AC source. In order for the induction heating system of FIG. 1 to support such a wide range of operating conditions, therefore, it is desirable that the leakage inductance of the transformer 148 be made as small as possible since even if the operator replaces the inductor 116 with a short circuit, and even if there is no other stray inductance in the system, the total series inductance between the AC source 110 and the work inductor 120 can never be less than $L_l/N^2$. (It is also desirable, of course, to lay out the circuit carefully in order to minimize other sources of stray inductance.)

The worst-case operating conditions of the system of FIG. 1 occur when the operator chooses the maximum specified operating frequency $f_{max}$, the maximum available output power $P_{max}$ and the minimum specified output power factor $PF_{min}$. In addition, the operator chooses the minimum specified output voltage $V_{Lmin}$, and the DC link voltage $V_{dc}$ in the inverter 134 is at its minimum value $V_{dcmin}$ (producing a minimum rms voltage into the output transformer of $V_{pmin}$). Under the worst case conditions of operation indicated above, the total series inductance from the AC source 110 to the work coil 120 should be no more than $$L_{SeffMax} = \frac{V_{Lmin} V_{pmin} PF_{\min}}{2\pi N f_{\max} P_{\max}} \quad (2)$$

Thus, even when the inductor 116 in FIG. 1 is replaced by a bus bar, the leakage inductance of the output transformer 148 of the AC source 110, when viewed from the secondary terminals 112 and 114, must be no greater than $L_{SeffMax}$. Preferably, in fact, to allow for some stray inductance in the load cabling 132 as well as to allow for some manufacturing and operating tolerances, the leakage inductance of the output transformer 148 when viewed from the secondary should no greater than approximately 0.25 $L_{SeffMax}$.

As an example, assuming worst case operating conditions of $V_{pmin}$=114V, $V_{Lmin}$=57V, $f_{max}$=400 kHz, $P_{max}$=5 kW, and $PF_{min}$=0.33, then the leakage inductance of the output transformer 148 (viewed from the secondary) should be no more than $L_{SeffMax}$=42 nH, and preferably only 25% of that. Conventional transformers used in conventional induction heating systems usually cannot achieve such low leakage inductance.

Transformer Design

Figure 2:
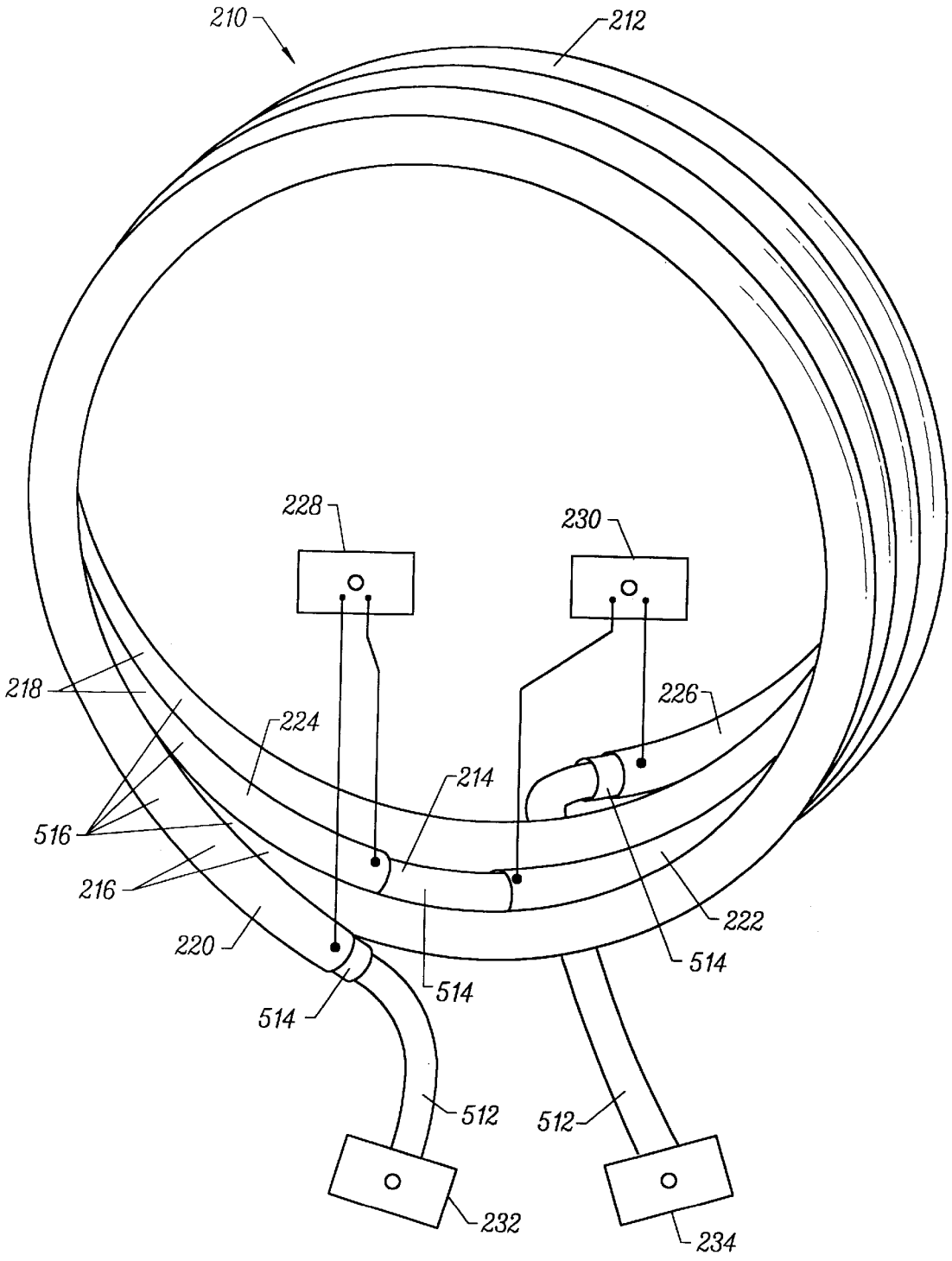
FIG. 2 is a perspective view of an output transformer that can be used in the system of FIG. 1.
Figure 3:
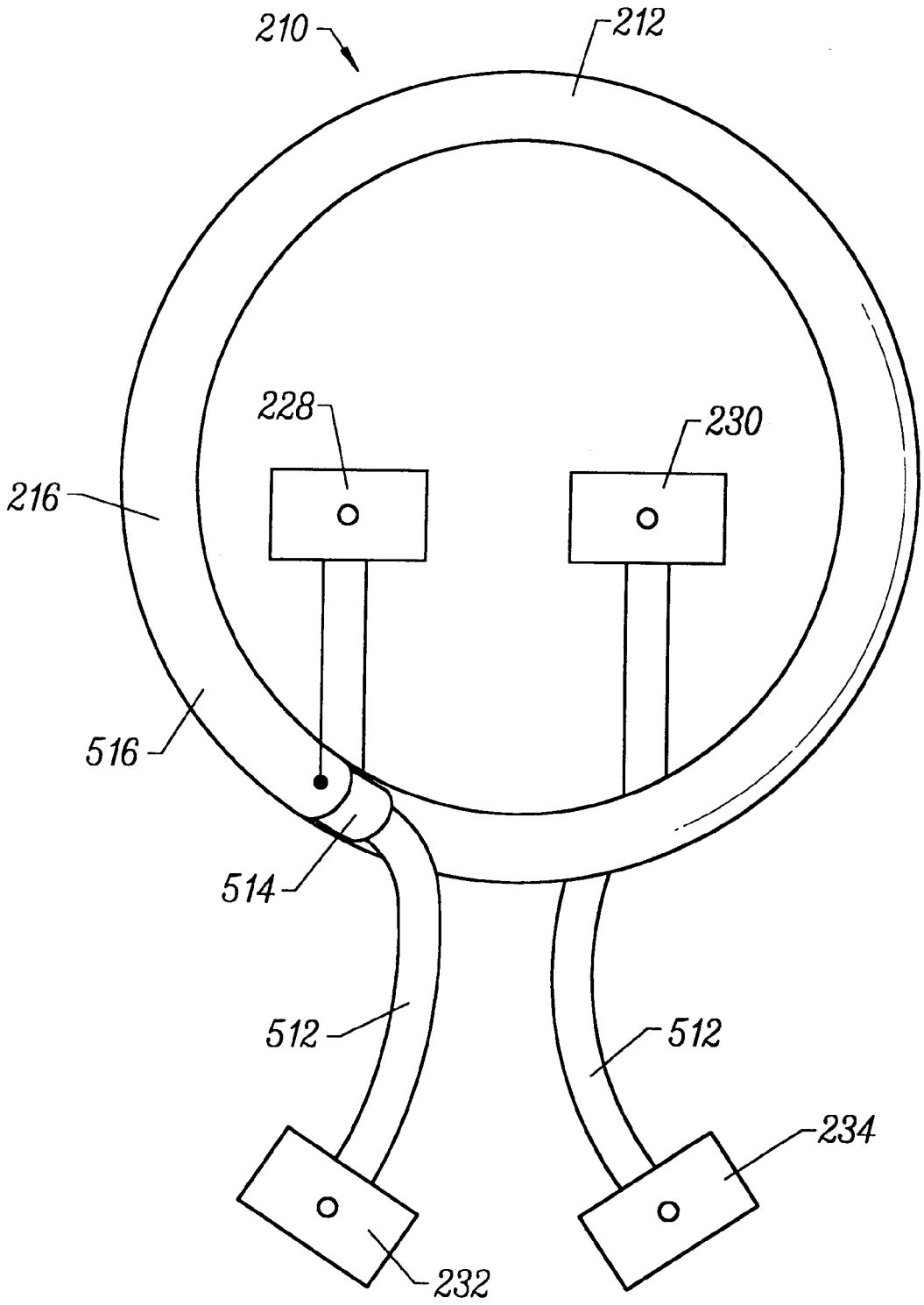
FIG. 3 is a head-on front view of the transformer of FIG. 2.
Figure 4:
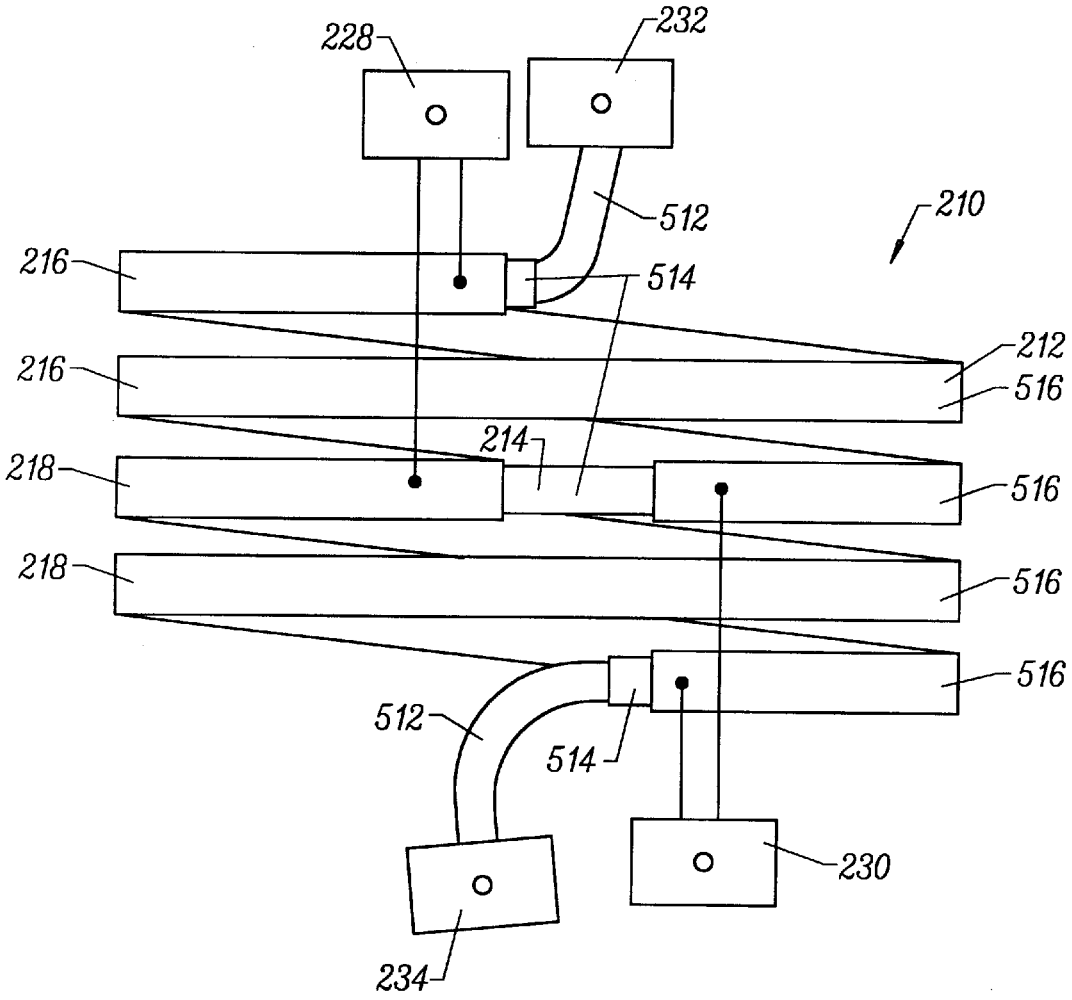
FIG. 4 is a view of the transformer of FIGS. 2 and 3, taken from the bottom of the illustrations in FIGS. 2 and 3, looking upward.
Figure 5:
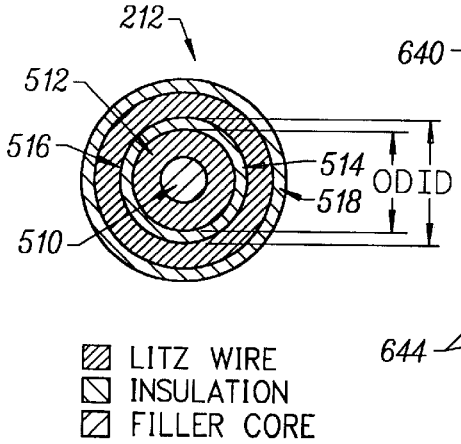
FIG. 5 illustrates a cross-section (not to scale) of the coaxial cable 212 in FIGS. 2–4.

FIG. 2 is a perspective view of a transformer design which can achieve the required low leakage inductance. It is a coaxial transformer 210 made up of a coaxial cable 212. FIG. 3 is a head-on front view of the transformer of FIG. 2, FIG. 4 is a view of the transformer 210 taken from the bottom of the illustrations in FIGS. 2 and 3, looking upward. The cable actually makes eight turns, although only four turns are illustrated in FIGS. 2 and 4 for clarity of illustration. FIG. 5 illustrates a cross-section (not to scale) of the coaxial cable 212 in FIGS. 2–4. At the center is a non-magnetic, insulating filler core 510, surrounded by an inner-winding conductor 512. The inner-winding conductor 512 is electrically a hollow conductor, due to the insulating filler core 510. Preferably, the inner conductor 512 is made of braided, stranded wire, preferably Litz wire. The use of Litz wire increases the AC current-carrying capacity of the inner conductor 512 by reducing the skin effect of the conductor.

Surrounding the inner conductor 512 is a layer of insulation 514, which may for example be made of heat-shrink tubing or conventional electrical tape. Preferably, the insulator 514 is very thin, for reasons described below. Surrounding the insulator 514. is the outer coaxial conductor 516 which may, again, be constructed from braided, stranded wire, preferably Litz wire. The outer most layer 518 of coaxial cable 212 is insulation (not shown in FIGS. 24 for clarity of illustration). The inner diameter of the outer conductor 516 is ID, and the outer diameter of the inner conductor 512 is OD.

The cable 212 and the transformer 210 are referred to herein as being "coaxial", but because the conductors are made of stranded braids rather than solid wire or tubes, they might not be coaxial at all positions along the length of the coax. This might be true also in embodiments where the conductors are made of tubes. The term "substantially coaxial" is used herein to accommodate manufacturing tolerances due to which the inner and outer conductors might not be exactly coaxial. Also, cables need not have a circular cross-section to be considered coaxial, as the term is used herein. Cables with rectangular cross-section conductors, for example, can be coaxial as well.

Referring again to FIGS. 2 and 4, it can be seen that whereas the inner conductor 512 is electrically continuous through all eight turns of the transformer (again, only four are shown in the figures), the outer conductor is electrically broken, with a longitudinal gap 214, after every second turn. Thus, the outer conductor has been cut into four two-turn segments (only two of which, 216 and 218, are shown in the figures). The segment 216 has a proximal end 220 and a distal end 222, and the segment 218 has a proximal end 224 and a distal end 226. The proximal ends 220 and 224 of each of the segments are connected together electrically and to a terminal 228, and the distal ends 222 and 226 of each of the segments are connected together electrically and to a terminal 230. Thus all of the segments 216 and 218 of the outer-winding 516 are connected in parallel. Since each such parallel-connected segment traverses only two turns of the coil, whereas the inner-winding 512 traverses the full eight turns, the transformer 210 effectively has a turns ratio of 4:1.

In the system of FIG. 1, the inner conductor 512 constitutes the primary winding of the transformer 148, and the outer-winding 516 constitutes the secondary winding of the transformer 148. Tabs 232 and 234 in FIGS. 2–4 represent the primary terminals 136 and 138 of the transformer 148, and the tabs 228 and 230 in FIGS. 2–4 represent the secondary terminals 112 and 114 in the transformer 148.

It will be appreciated that the same construction as that shown in FIGS. 2–4 can be used as a step-up transformer by using the outer conductor 516 as the primary and the inner conductor 512 as the secondary. It will also be appreciated that whereas the conductor which has been segmented and connected in parallel in the transformer of FIGS. 2–4 is the outer conductor 516, in another embodiment, it could be the inner conductor 512 which is segmented and connected in parallel. In yet another embodiment, the segmented winding can even be made from the outer conductor 516 along one length of the coax, and the inner conductor 512 along a different length of the coax. Numerous other variations will be apparent.

In general, if the electrically continuous winding extends through T turns, and the electrically discontinuous winding is cut into S segments, each segment extending through substantially T/S of the T turns, then the resulting coaxial transformer will have a turns ratio of substantially S:1. It will be appreciated that the number of turns of the continuous winding need not be an integer, and can also be less than one. The number of segments into which the discontinuous winding is broken is an integer greater than one. The number of turns through which each segment of the discontinuous winding extends is referred to herein as being "substantially" an integer, thereby allowing for tolerance of a longitudinal gap between the distal end of one segment and the proximal end of the next, such as can be seen in FIGS. 2 and 4.

The leakage inductance of a coaxial transformer, measured on the primary side, is given by $$L_{cx} = \frac{\mu_0}{2\pi} \ln\left(\frac{ID}{OD}\right) l_c, \quad (3)$$

where $\mu_0$ is the permeability of free space ($4\pi\times10^{-7}$H/m) and $l_c$ is the length of the cable. Thus, the leakage inductance can be minimized by keeping ID/OD very small, such as by using a very thin inter-winding insulator 514. Preferably, the insulator 514 is heat-shrink tubing and has a thickness of no more than 0.5 mm.

The leakage inductance will be minimized also if the length $l_c$ of the cable is minimized. The minimum cable length $l_c$ is limited, however, by the magnetizing inductance required for the transformer. The magnetizing inductance $L_M$ of an air core cylindrical coaxial transformer is given by $$L_M = \frac{(r_t N_t)^2}{9r_t + 10l_t}, \tag{4}$$

where $r_t$ is the radius of the cylindrical coil (inches), $N_t$ is the number of turns of coil, and $l_t$ is the cylindrical length of the coil (in the dimension approximately perpendicular to a plane of a turn of coil). This is an empirical equation in which one inch represents one microhenry of magnetizing inductance. With the inverter 134 in FIG. 1, the minimum required magnetizing inductance $L_M$ is determined by the required peak magnetizing current $I_{Mpeak}$ at the minimum switching frequency $f_{min}$, and is given by $$L_M = \frac{V_{dc}}{8I_{Mpeak} f_{min}}. \tag{5}$$

The derivation of the peak magnetizing current requirement is unimportant for an understanding of the invention, and it is sufficient to note herein that it is determined by the required current for zero-voltage switching of the inverter 134 and the current rating of the semiconductor switches 140 and 142. For the example range of operating conditions set forth previously, and for $I_{Mpeak}$=40 A, $f_{min}$=50 kHz, and $V_{dc}$=320 V, this formula yields a required minimum magnetizing inductance $L_M$=20 $\mu$H. A higher magnetizing inductance would not be detrimental since it can always be reduced if desired by connecting an additional inductor across the primary terminals 136 and 138 of the transformer 148.

From equation 4, it can be seen that a cylindrical coaxial transformer having $N_t$=8 turns, a radius of $r_t$=6 inches, and a cylindrical length of $l_t$=7.75 inches (0.75 inch diameter cable with turns spaced apart by 0.25 inches), has a magnetizing inductance of $L_M$=17.5 $\mu$H, which is close to the requirement. From equation 3 above, if the cable has an inter-winding insulation thickness of 0.5 mm, ID=17 mm, OD=16 mm and a coaxial length of $l_c$=7.7 meters, such a coaxial transformer would have a leakage inductance $L_{cx}$= 93 nH. Transposed to the secondary, this represents a leakage inductance of only $L_l$=5.8 nH as viewed from the secondary, which is less than the 42 nH maximum calculated above and therefore acceptable for the induction heating system to be able to support the desired range of operating conditions.

One problem with the air core cylindrical coaxial transformer of FIGS. 2–4 is that while it exhibits low leakage inductance, it also exhibits high inter-winding capacitance $C_{iw}$. $C_{iw}$ in a coaxial transformer (viewed from the primary) is given by $$C_{iw} = \frac{2\pi\epsilon_0}{\ln\left(\frac{ID}{OD}\right)} l_c, \tag{6}$$

where $\epsilon_0$ is the perimittivity of free space ($8.854\times10^{-12}$ F/m), and the other variables are as defined above. It can be seen that while a small ID/OD reduces the leakage inductance, it also increases the inter-winding capacitance. In the example air core coaxial transformer design set forth above, equation 6 yields an inter-winding capacitance of $C_{iw}$=7 nF. Under certain circuit conditions and layouts, this capacitance will resonate with various parasitic inductances in the system and cause the circuit to oscillate. Oscillations can also vary as a function of the power factor. In such situations, it may be concluded that an air core cylindrical coaxial transformer which is large enough to achieve the required magnetizing inductance $L_M$ cannot be constructed which has both sufficiently low leakage inductance to support the desired range of operating conditions and sufficiently low inter-winding capacitance to prevent oscillations. Under such conditions, a transformer such as that of FIGS. 6 and 7 may be used.

Figure 6:
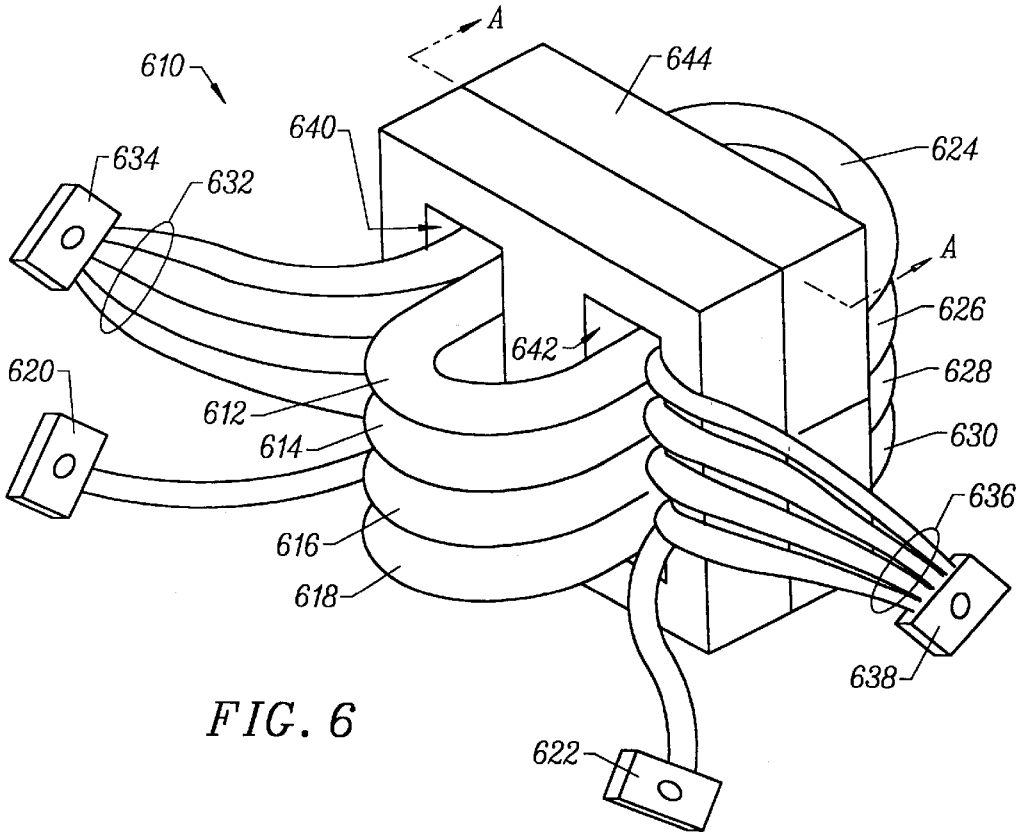
FIG. 6 is a perspective view of another output transformer that can be used in the system of FIG. 1.
Figure 7:
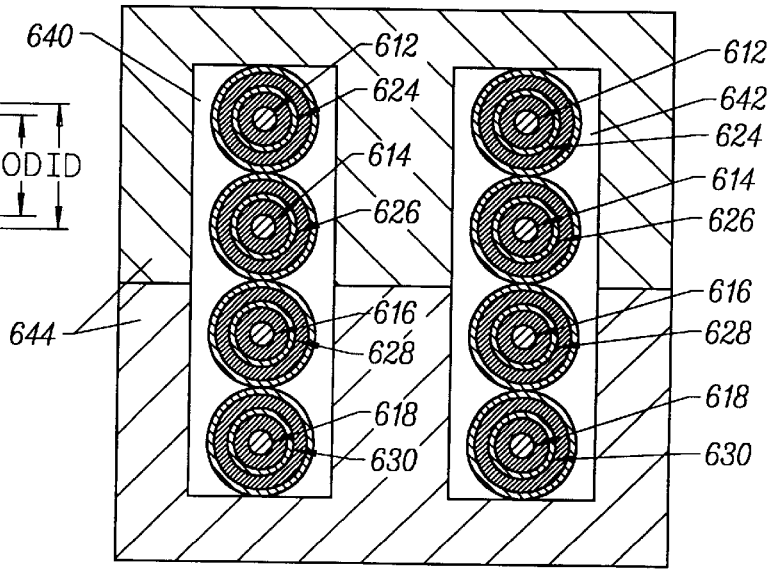
FIG. 7 is a cross-sectional view of the transformer of FIG. 6, taken along the sight lines A—A.

FIG. 6 is a perspective view of a transformer 610, and FIG. 7 is a cross-sectional view of the transformer 610, taken along the sight lines A—A. The transformer 610 is again a coaxial transformer, having four turns 612, 614, 616 and 618 of electrically continuous inner conductor acting as the primary, and the outer conductor is electrically segmented into four segments 624, 626, 628 and 630. The proximal ends 632 of all four outer-winding segments are connected together electrically at a tab 634, and the distal ends 636 of each of the outer conductor segments are connected together electrically at a tab 638. Tabs 620 and 622 act as the primary terminals and tabs 634 and 638 act as the secondary terminals of the transformer 610. All of the turns of all of the windings pass through two windows 640 and 642 formed by ferrite E-cores 644. It can be seen from FIG. 6 that while each of the outer-winding segments of the transformer of 610 extends through more than one-half turn of the inner-winding, they do not extend through a full turn due to the large longitudinal gap between the point on each turn where the distal end of one of the outer-winding segments peels off the coax, and the point where the proximal end of the next outer-winding segment re-joins the coax. However, one effect of the cores 644 is to concentrate the flux lines, thereby giving each segment of the outer-winding almost the same effect as if it extended through a full turn of the inner-winding.

The construction of the coaxial cable itself is the same as that shown in FIG. 5, although the dimensions can now be made significantly different due to the presence of the cores 644. In particular, the cores provide a very large magnetizing inductance, much larger than is required to meet the peak magnetizing current requirement set forth above. The magnetizing inductance of transformer 610 may be reduced, if desired, either by connecting another inductor across the transformer primary terminals as previously described, or by creating an appropriate air gap between the two opposing halves of the E-cores 644.

Since the magnetizing inductance requirement no longer dictates a minimum coax length for the transformer, the length $\mathbf{l}_c$ is now dictated only by the physical size of the cores and the number of times that the coax must wrap around them to achieve the desired turns ratio (4:1 in FIG. 6). This permits a much shorter length of coax than was required for the air core coaxial transformer of FIGS. 2–4. The overall size of the ferrite core transformer can also be made much smaller than that of the air-core cylindrical coaxial transformer of FIGS. 2–4. As with the air core transformer, leakage inductance can be minimized by keeping the inter-winding insulation thin. This tends to increase the inter-winding capacitance, but the much shorter permissible length of coaxial cable tends to reduce the inter-winding capacitance to an acceptable level.

In the example above, sufficiently low-leakage inductance and inter-winding capacitance can be achieved, with sufficiently high magnetizing inductance, using an appropriate ferrite core coaxial transformer such as that shown in FIGS. 6 and 7 in which the coaxial conductors are 0.8 m in length, ID=11 mm, OD=10 mm. The number of turns of the primary winding is four, and the number of parallel-connected secondary winding segments is four, yielding a turns ratio of 4:1. Referring to equations 3 and 6 above for leakage inductance and inter-winding capacitance, it can be seen that these values yield a leakage inductance on the primary side of only 15 nH (1 nH as viewed from the secondary), and an inter-winding capacitance of $C_{iw}$=470 pF. The leakage inductance is sufficiently small to permit the induction heating system to support the desired wide range of operational conditions, and the inter-winding capacitance is sufficiently small to avoid unwanted oscillation. Note that many other well-known core shapes and sizes can be used in different embodiments, other than the E-shaped cores shown in the figures herein.

Split Resonance Capacitance

Referring again to FIG. 1, as previously mentioned, the tank circuit 118 includes a work coil 120 connected in parallel with a resonance capacitance 122. The term "capacitance" is used herein to represent a value, whereas the word "capacitor" represents a particular component having a capacitance value. In the induction heating system, the resonance capacitance is given by $$C_r = \frac{L_W + L_{Seff}}{4\pi^2 f_{res}^2 L_W L_{Seff}}, \tag{7}$$

where $f_{res}$ is the resonant frequency of the tank circuit and $L_{Seff}$ is the effective series inductance from the AC source 110 to the work coil 120, including both $L_s$ and the output inductance of the AC source 110. Optimum efficiency of operation is achieved at the maximum power factor output of the inverter 134, which occurs when the frequency of operation is slightly above the resonant frequency $f_{res}$ of the tank, although to simplify calculations it is assumed herein that the frequency of operation is equal to $f_{res}$. For certain applications, it might be desirable to place the AC source 110 at a significant distance from the working location of the work coil 120. In this case, load cabling 132 is installed to carry the current from the AC source 110 to the work coil 120. The series inductor 116 is connected between the AC source 110 and the proximal end of the load cabling 132. Load cabling 132 can be expensive and difficult to install if it is required to carry a significant amount of current. Therefore, in order to minimize the current carrying requirement of the load cable 132, the capacitance 122 is split, with one capacitor 124 mounted near the AC source 110 and the other capacitor 126 mounted near the work coil 120. Optimally, the two capacitors are chosen such as to bring the power factor of the current in the load cable 132 to unity. If the power factor at the input of the transformer is unity, which is approximately the case under normal and typical conditions of operation, the power factor of the current in the load cable 132 achieves unity when the operating frequency $f=f_{res}$, when the capacitance of capacitor 124 is $$C_S = \frac{1}{4\pi^2 f^2 L_{Seff}}, \tag{8}$$

and when the capacitance of capacitor 126 is $$C_L = \frac{1}{4\pi^2 f^2 L_W}. \tag{9}$$

(If the power factor at the input of the transformer is less than unity, then whereas equation 9 above for $C_L$ remains valid, equation 8 for $C_s$ does not. Instead, $C_s$ can be calculated as $C_s=C_r-C_L$. Note also that capacitors 124 and 126 can each be implemented with several capacitors, if desired.)

It can be seen also from equations 8 and 9 that when the power factor at the input of the transformer is unity, $$\frac{C_S}{C_L} = \frac{L_W}{L_{Seff}}. \tag{10}$$

Tuning the System

As mentioned, the system of FIG. 1 can be tuned to operate under a wide variety of operating conditions. Tuning basically involves selecting the resonance capacitance $C_r$ and the inductance $L_s$ of inductor 116. The inductor 116 is chosen according to the formula $L_{s=LSeff}-L_o$, where $L_o$ is the output inductance of the AC source 110, and $L_{Seff}$ is given by $$L_{Seff} \approx \frac{V_L V_p}{2\pi N f P}. \tag{11}$$

This equation is valid for PF=1 and is most accurate when $V_L \geqq 2V_p/N$. The resonance capacitance is then determined according to equation 7 set forth above.

Figure 8:
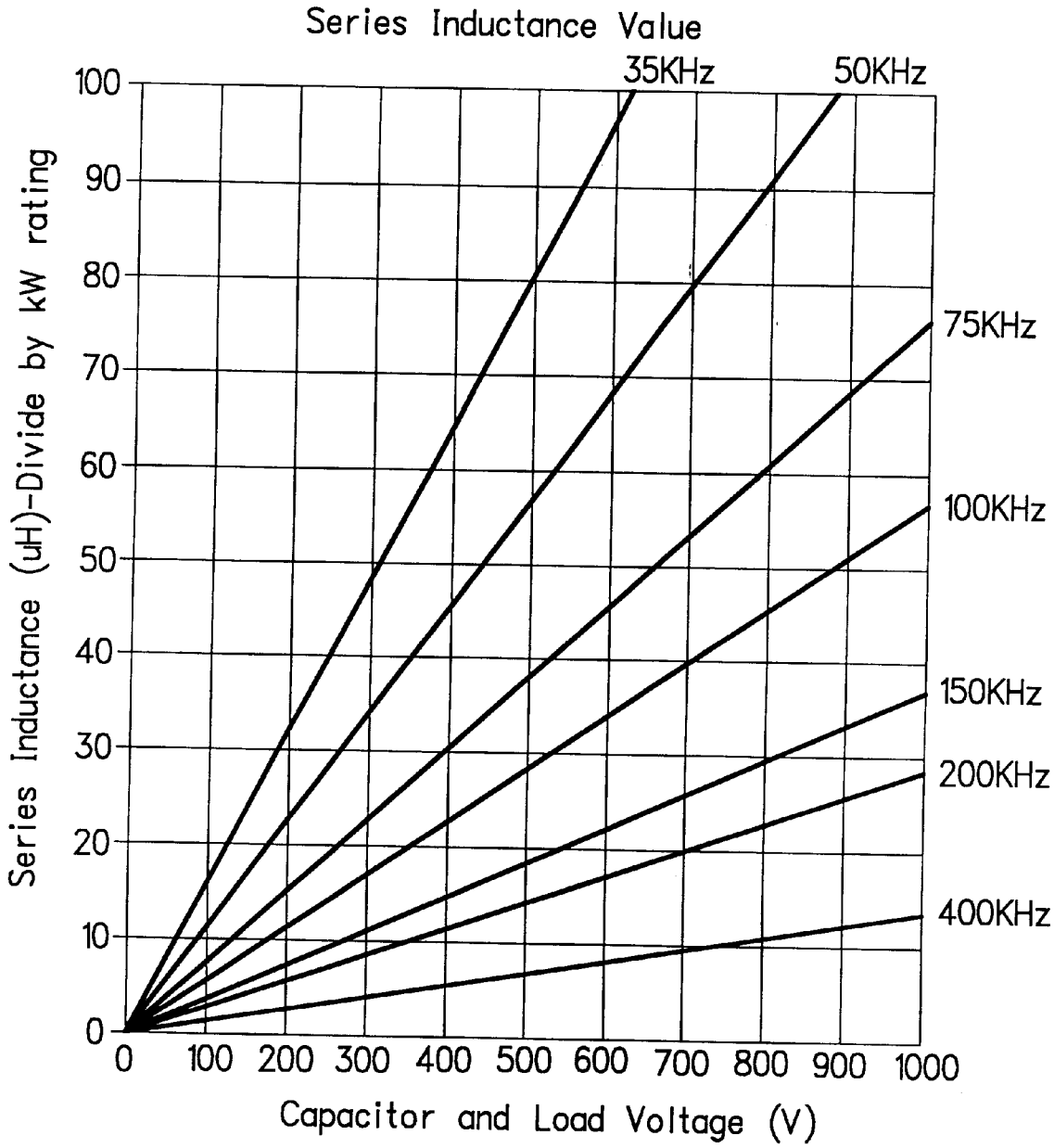
FIGS. 8 and 9 are charts that can be used in a simplified tuning procedure for an induction heating system such as that shown in FIG. 1.

In accordance with an aspect of the invention, in an embodiment which does not split the capacitor 122, a very simple procedure may be used for tuning induction heating apparatus such as that shown in FIG. 1. First, the operator selects the desired operating frequency according to the application. For example, for surface heating, the operator will choose a higher frequency of operation, whereas for deep heating, the operator will choose a lower frequency of operation. The operator also selects a desired load voltage $V_L$. Then the operator selects a preliminary series inductance $L_s$. The preliminary selection can be made from a table, equation or chart provided by the vendor of the induction heating system, which relates series inductance to the approximate desired load voltage for a variety of supported operating frequencies. One such chart is illustrated in FIG. 8. The preliminary series inductance $L_s$ need not be precise at all since the subsequent steps of the tuning procedure will correct any errors.

The chart of FIG. 8 represents the equation $$L_S = \frac{V_L V_p}{2\pi N f P}, \tag{12}$$

for several frequencies of operation f. The curves in the chart are independent of the Q of the load. They are also normalized for a power output rating of P=1 kW, so the inductance read from the chart should be divided by the desired kW rating. For example, for P=5 kW, the inductance value read from the chart should be divided by 5.

Figure 9:
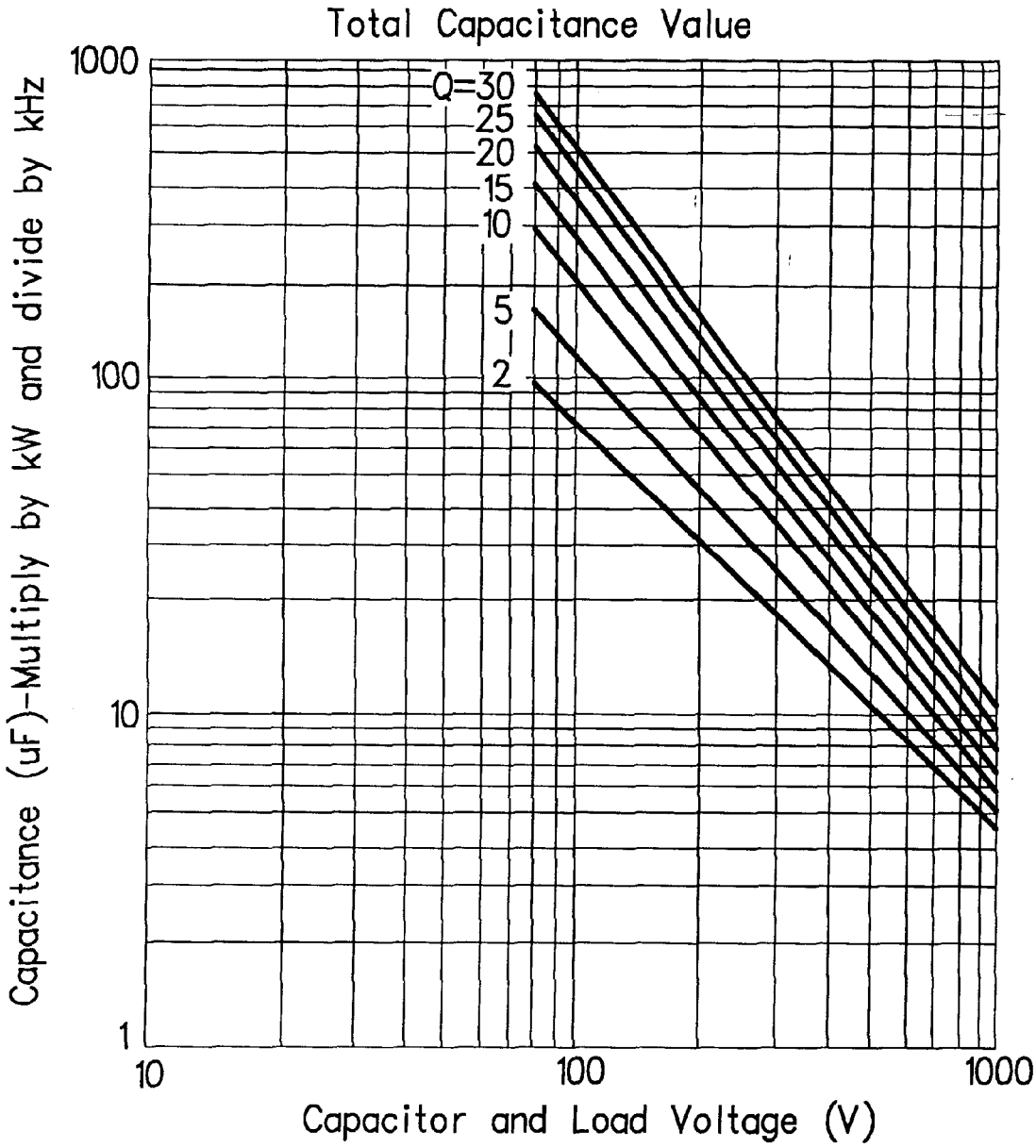

Next, the user selects a preliminary resonance capacitance $C_r$ from another table, formula or chart provided by the vendor of the induction heating system. An example of such a chart is shown in FIG. 9. This chart relates the preliminary resonance capacitance to the desired load voltage for a variety of values of Q. Q is the quality factor, and is given by $$Q = \frac{V_L^2}{2\pi L_W f P}. \tag{13}$$

Again, the preliminary capacitance value chosen need not be accurate at all since the following steps of the tuning procedure correct any errors. The chart of FIG. 9 represents the equation $$C_r = \frac{P}{2\pi f V_L}\left(\frac{N}{V_p} + \frac{Q}{V_L}\right), \tag{14}$$

for several values of Q. The curves in the chart are normalized for a power output rating of P=1 kW and for a frequency of operation of 1 kHz, so the capacitance read from the chart should be multiplied by the desired kW rating and divided by the resonant frequency in kHz. For example, for P=5 kW and f=100 kHz, the capacitance value read from the chart should be multiplied by 5/100.

The operator then turns on the system to approximately 5% or more of full power. If the frequency at which the system is operating, which appears on gauge 145 (FIG. 1), is higher than the desired frequency of operation, the operator replaces the preliminary capacitance $C_r$ with a capacitor having a larger capacitance value. If the gauge indicates that the frequency of operation is lower than desired, the operator replaces the resonance capacitor with one having a smaller capacitance value. This step is repeated iteratively until the desired frequency of operation is reached.

Next, the operator turns up the system to full power. This will decrease the frequency of operation by a small amount, but not more than about 10%. If the operator finds that the system is current limited, as reported by current limit indicator 155, then the operator increases the series inductance $L_s$. If the operator finds that the system is resonant limited, as reported by indicator 163, then the operator decreases $L_s$. This step repeats iteratively until the system is neither current limited nor resonant limited. Desirably, but not essentially, the operator should choose an $L_s$ such that the system is just out of resonance limit, since this provides optimum efficiency of operation (highest PF). At this point the system of FIG. 1 is tuned and ready for operation.

It can be seen that this tuning procedure is extremely simple, and allows the use of the induction heating system of FIG. 1 over a wide variety of desired operating conditions without requiring a detailed understanding of the principles of operation. The vendor of the induction heating system can easily instruct an operator on this turning procedure. The tuning procedure is not limited for use with the system of FIG. 1, but may be used with any induction heating system having the same topology (inductance in series with a parallel tank circuit), on which the series inductance and resonance capacitance can be changed or adjusted by the operator.

The tuning procedure just described can be extended for use in split capacitor embodiments such as that shown in FIG. 1. In particular, for the split capacitor embodiment, $C_r$ and $L_s$ are first determined according to the above procedure for the non-split case, with all the capacitance being placed at the load end of the load cabling 132 (i.e. in position 126). Capacitance is then moved from the load end of the load cabling to the source end of the load cabling (i.e. to position 124), until the power factor of the current carried in the load cabling 132 is at its maximum (as close to unity as possible). In one embodiment, the amount of capacitance to move can be determined from charts or by calculation:

$$C_S = \frac{1}{4\pi^2 f^2 L_{Seff}}, \tag{15}$$

and all the rest of the capacitance remains at the load end of load cabling 132. In another embodiment, the amount of capacitance to move is determined by means of a power factor meter (not shown) located the load cabling 132. Capacitance is moved until the power factor indicated on the meter is at its maximum (as close to unity as possible).

In yet a third embodiment, the amount of capacitance to move is determined by means of a current meter or current pickup (not shown) responding to the amount of current in load cabling 132. The accuracy of the measurement is not important, and any signal that is proportional to the current will suffice. According to this third embodiment, capacitance is iteratively moved from the load end of load cabling 132 to the source end of load cabling 132. The current measured by the current meter decreases with each iteration until at some point it starts to increase. At that point the last amount of capacitance moved from the load end to the source end of load cabling 132 is returned to the load end, and the correct split has been achieved.

Note that whereas the procedure just described for determining the split capacitor values assumes that the total capacitance value $C_r$ has already been determined, it will be appreciated that in another embodiment, a user can determine $C_s$ and $C_L$ directly from charts or equations without having to determine $C_r$ first.

Final Remarks

The formulas set forth above are for optimum performance. It will be understood that the values used in an actual circuit might differ somewhat from those described herein, if the performance degradation caused thereby is acceptable for the purposes of the device. Also, even for optimum performance, parasitic impedances not otherwise considered herein may mandate small deviations from the formulas set forth herein.

As used herein, a given signal, event or value is "responsive" to a predecessor signal, event or value if the predecessor signal, event or value influenced the given signal, event or value. If there is an intervening processing element, step or time period, the given signal, event or value can still be "responsive" to the predecessor signal, event or value. If the intervening processing element or step combines more than one signal, event or value, the signal output of the processing element or step is considered "responsive" to each of the signal, event or value inputs. If the given signal, event or value is the same as the predecessor signal, event or value, this is merely a degenerate case in which the given signal, event or value is still considered to be "responsive" to the predecessor signal, event or value. "Dependency" of a given signal, event or value upon another signal, event or value is defined similarly.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. In particular, and without limitation, any and all variations described, suggested or incorporated by reference in the Background section of this patent application are specifically incorporated by reference into the description herein of embodiments of the invention. The embodiments described herein were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. A method for tuning an induction heating system having an AC source and a work coil, comprising the steps of:

operating said induction heating system with a preliminary series inductance connected between said AC source and said work coil and with a preliminary capacitance connected across said work coil;

modifying said preliminary capacitance until current through said work coil oscillates at a desired frequency of oscillation; and modifying said preliminary series inductance until said induction heating system delivers a desired power level to said work coil.

2. A method according to claim 1, wherein said AC source has an output inductance $L_O$, and wherein said AC source has an output transformer having an rms input voltage $V_p$ and a primary:secondary turns ratio of N, wherein said steps of operating and modifying yield a series inductance $L_S$ between said AC source and said work coil, where $L_S$ is given by the formula $$L_S = L_{Seff} - L_O,$$

where $$L_{Seff} \approx \frac{V_L V_p PF}{2\pi NfP},$$

$V_L$ is a desired work coil voltage, f is a desired frequency of operation,

P is a desired power level to be delivered to said work coil, and

PF is a power factor of current into said output transformer.

3. A method according to claim 2, wherein said induction heating system includes a tank circuit which includes said work coil, and wherein said preliminary series inductance is formed between said AC source and said tank circuit.

4. A method according to claim 2, further comprising the steps of:

connecting a load cable in series between said series inductance and said work coil; and dividing said preliminary capacitance into first and second capacitances connected across said load cable at opposite ends thereof.

5. A method according to claim 4, wherein said first capacitance is connected nearer to said series inductance than is said second capacitance, wherein said work coil has an inductance $L_W$, wherein after said steps of modifying said preliminary capacitance and dividing said preliminary capacitance, said first capacitance is given by $$C_S = \frac{1}{4\pi^2 f^2 L_{Seff}},$$

and wherein after said steps of modifying said preliminary capacitance and dividing said preliminary capacitance, said second capacitance is given by $$C_L = \frac{1}{4\pi^2 f^2 L_W}.$$

6. A method according to claim 2, wherein said work coil has an inductance $L_W$, and wherein after said step of modifying said preliminary capacitance, the capacitance across said work coil is given by $$C_r = \frac{L_W + L_{Seff}}{4\pi^2 f^2 L_W L_{Seff}}.$$

7. A method according to claim 2, wherein said output transformer has a leakage inductance which forms part of said AC source output inductance.

8. A method according to claim 2, wherein said step of forming a series inductance between said AC source and said work coil, comprises the step of inserting an inductor between said AC source and said work coil.

9. A method according to claim 1, wherein said step of operating comprises the step of operating said induction heating system at low power during said step of modifying said preliminary capacitance.

10. A method according to claim 1, further comprising the step of, prior to said step of operating said induction heating system, selecting said preliminary capacitance in dependence upon a desired load voltage.

11. A method according to claim 1, wherein said step of modifying said preliminary capacitance comprises the step of increasing said preliminary capacitance if said current through said work coil oscillates at a frequency higher than said desired frequency of oscillation, and decreasing said preliminary capacitance if said current through said work coil oscillates at a frequency lower than said desired frequency of oscillation.

12. A method according to claim 1, wherein said step of modifying said preliminary capacitance occurs prior to said step of modifying said preliminary series inductance.

13. A method according to claim 1, wherein said induction heating system further has load cabling connected between said preliminary series inductance and said work coil, said preliminary capacitance being connected across said work coil at a load position between said load cabling and said work coil, further comprising the step of, after said step of modifying said preliminary capacitance until current through said work coil oscillates at a desired frequency, moving capacitance from said load position to a source position across said work coil between said AC source and said load cabling until current through said load cabling has a maximum power factor.

14. A method according to claim 1, wherein said induction heating system further has load cabling connected between said preliminary series inductance and said work coil, said preliminary capacitance being connected across said work coil at a load position between said load cabling and said work coil, further comprising the step of, after said step of modifying said preliminary capacitance until current through said work coil oscillates at a desired frequency, moving capacitance from said load position to a source position across said work coil between said AC source and said load cabling until a current level in said load cabling reaches a minimum value.

15. A method according to claim 1, wherein said step of operating comprises the step of operating said induction heating system at full power.

16. A method according to claim 1, further comprising the step of, prior to said step of operating, selecting said preliminary series inductance in dependence upon a desired load voltage.

17. A method according to claim 16, wherein said step of selecting said preliminary series inductance is performed further in dependence upon a desired operating frequency.

18. A method according to claim 1, wherein said step of modifying said preliminary series inductance comprises the step of increasing said preliminary series inductance if said induction heater is current limited, and decreasing said preliminary series inductance if said induction heater is resonance limited.

19. A method according to claim 1, wherein said step of modifying said preliminary capacitance occurs at low power and prior to said step of modifying said preliminary inductance, and comprises the steps of:

increasing said preliminary capacitance if said work coil oscillates at a frequency higher than said desired frequency of oscillation; and decreasing said preliminary capacitance if said work coil oscillates at a frequency lower than said desired frequency of oscillation.

20. A method according to claim 1, wherein said step of modifying said preliminary capacitance occurs prior to said step of modifying said preliminary series inductance.

21. A method for tuning an induction heating system having an AC source and a work coil, comprising the steps of:

operating said induction heating system with a preliminary capacitance connected across said work coil;

monitoring the frequency at which current through said work coil oscillates; and modifying said preliminary capacitance until current through said work coil oscillates at a desired frequency of oscillation.

22. A method according to claim 21, wherein said step of operating comprises the step of operating said induction heating system at low power during said step of modifying said preliminary capacitance.

23. A method according to claim 21, further comprising the step of, prior to said step of operating said induction heating system with a preliminary capacitance connected across said work coil, selecting said preliminary capacitance in dependence upon a desired load voltage.

24. A method according to claim 21, wherein said step of modifying said preliminary capacitance comprises the step of increasing said preliminary capacitance if said current through said work coil oscillates at a frequency higher than said desired frequency of oscillation, and decreasing said preliminary capacitance if said current through said work coil oscillates at a frequency lower than said desired frequency of oscillation.

25. A method according to claim 21, wherein said step of modifying said preliminary capacitance occurs prior to said step of modifying said preliminary series inductance.

26. A method according to claim 21, wherein said induction heating system further has load cabling connected between said preliminary series inductance and said work coil, said preliminary capacitance being connected across said work coil at a load position between said load cabling and said work coil, further comprising the step of, after said step of modifying said preliminary capacitance until current through said work coil oscillates at a desired frequency, moving capacitance from said load position to a source position across said work coil between said AC source and said load cabling until current through said load cabling has a maximum power factor.

27. A method according to claim 21, wherein said induction heating system further has load cabling connected between said preliminary series inductance and said work coil, said preliminary capacitance being connected across said work coil at a load position between said load cabling and said work coil, further comprising the step of, after said step of modifying said preliminary capacitance until current through said work coil oscillates at a desired frequency, moving capacitance from said load position to a source position across said work coil between said AC source and said load cabling until a current level in said load cabling reaches a minimum value.

28. An induction heating method, comprising the steps of instructing an operator of an induction heating system to tune said system in accordance with the method of any of claims 2–27.

* * * * *